US007877818B2

(12) United States Patent
Halseth

(10) Patent No.: US 7,877,818 B2
(45) Date of Patent: Feb. 1, 2011

(54) EASY ON AND OFF COLLAR FOR A PROTECTIVE GARMENT

(75) Inventor: Thor Halseth, Agoura Hills, CA (US)

(73) Assignee: S2S Design, Inc., Sea Isle City, NJ (US)

( * ) Notice: Subject to any disclaimer, the term of this patent is extended or adjusted under 35 U.S.C. 154(b) by 13 days.

(21) Appl. No.: 12/322,037

(22) Filed: Jan. 27, 2009

(65) Prior Publication Data

US 2010/0024094 A1 Feb. 4, 2010

Related U.S. Application Data

(60) Provisional application No. 61/137,365, filed on Jul. 29, 2008.

(51) Int. Cl.
*A41B 3/08* (2006.01)
*A41D 13/12* (2006.01)

(52) U.S. Cl. ..... 2/51; 2/52; 2/114; 2/129

(58) Field of Classification Search ..... 2/51, 2/52, 48, 49.1, 49.2–49.4, 114, 50, 116, 129, 2/139, 132, 255–259, 264, 456, 457, 463, 2/468, 69, 46, 88, 92, 104, 134, 901; 24/7, 24/9

See application file for complete search history.

(56) References Cited

U.S. PATENT DOCUMENTS 115,238 A * 5/1871 Raiford ..... 24/9
361,537 A * 4/1887 Morrison ..... 2/52
383,847 A * 6/1888 Baker ..... 24/9
392,676 A * 11/1888 Jacoby ..... 2/52
463,884 A 11/1891 Anderson
788,489 A * 4/1905 Moore ..... 2/51
869,259 A 10/1907 Peacock
912,958 A 2/1909 Hawks
925,655 A * 6/1909 Round ..... 2/52
1,102,431 A 7/1914 Parsons
1,243,462 A * 10/1917 Troiano ..... 2/50
1,391,121 A * 9/1921 Keppel ..... 2/49.5
1,424,215 A * 8/1922 Rowe ..... 296/81
1,628,433 A 5/1927 Schilke
1,764,212 A 6/1930 Kirsten
2,080,107 A * 5/1937 Brandstein ..... 2/50
2,154,464 A * 4/1939 Lozier ..... 2/309
2,421,195 A 2/1946 Goldsmith
2,510,030 A 5/1950 Carlisle
2,525,115 A * 10/1950 Britton ..... 2/49.2
2,587,860 A 3/1952 Kohl et al.
2,649,587 A * 8/1953 Sewaringen ..... 2/52
2,655,659 A * 10/1953 Swearingen ..... 2/52
2,783,472 A * 3/1957 Lenger ..... 2/49.1
2,804,624 A * 9/1957 Schattel ..... 2/49.3

(Continued)

*Primary Examiner*—Amy B Vanatta
(74) *Attorney, Agent, or Firm*—Cislo & Thomas, LLP

(57) ABSTRACT

An improved collar mechanism and method of use for the securing of reusable gowns typically used in health care settings around the neck of a user without the need to secure with ties, tabs, snaps or other securing devices. The collar mechanism is made of a stiff material that is pliable enough to move without fracture when force is applied but with a sufficient memory that allows the collar to return to its original position once the force is removed or when modeled as such.

12 Claims, 3 Drawing Sheets

U.S. PATENT DOCUMENTS 2,814,425 A 11/1957 Rutt
2,875,446 A 3/1959 Snincak
2,884,638 A * 5/1959 Ream ..... 2/48
3,058,119 A 10/1962 Snincak
3,114,152 A 12/1963 Blue
3,470,568 A * 10/1969 Belkin ..... 2/114
D226,744 S * 4/1973 Chaffin ..... D2/860
3,729,747 A 5/1973 Belkin
3,824,625 A 7/1974 Green
3,843,971 A 10/1974 Delanty et al.
3,911,499 A 10/1975 Benevento et al.
3,977,025 A 8/1976 Horan
4,290,148 A * 9/1981 Roberts ..... 2/51
4,384,370 A 5/1983 Singer
4,558,468 A 12/1985 Landry et al.
4,608,719 A 9/1986 Lunt
4,644,589 A 2/1987 Pettis
4,653,120 A 3/1987 Leaf
4,674,132 A 6/1987 Stein et al.
4,864,657 A 9/1989 Lake
4,937,884 A 7/1990 Sherman
5,133,086 A 7/1992 Truitt et al.
5,253,642 A 10/1993 Stackhouse et al.
5,414,867 A 5/1995 Bowling et al.
5,621,916 A 4/1997 Bell
5,624,154 A 4/1997 Kishi
5,769,287 A 6/1998 Kim
5,848,439 A 12/1998 Huseth et al.
5,862,525 A 1/1999 Tankersley et al.
5,878,437 A 3/1999 Pater
5,901,376 A 5/1999 Deirmendjian et al.
6,049,907 A 4/2000 Palomo
6,138,278 A 10/2000 Taylor et al.
6,378,136 B2 4/2002 Matsushita
6,836,900 B1 * 1/2005 Fus, Sr. ..... 2/52
6,859,938 B1 3/2005 Niski et al.
7,093,304 B2 8/2006 Griesbach, III
D530,885 S 10/2006 Barthel
7,269,855 B2 * 9/2007 LaRocco ..... 2/49.1
7,305,716 B1 12/2007 Richards
2005/0044603 A1 3/2005 Graver
2005/0044608 A1 3/2005 Ambrose et al.
2005/0132465 A1 6/2005 Kathumbi-Jackson et al.
2006/0117452 A1 * 6/2006 Ambrose ..... 2/51

* cited by examiner

EASY ON AND OFF COLLAR FOR A PROTECTIVE GARMENT

REFERENCE TO PRIOR APPLICATION

This application claims the priority of provisional application 61/137,365, filed Jul. 29, 2008 entitled HOSPITAL GOWN WITH EASY ON AND OFF COLLAR by Thor Halseth.

BACKGROUND OF THE INVENTION

1. Field of the Invention

The present invention relates generally to the field of protective garments and specifically to a collar enclosure that allows for quick and easy securing to the wearer's neck.

2. Description of the Prior Art

Protective garments are used in medical settings to cover patients and health care workers alike to isolate the patients from ambient germs found on practitioners' clothing and to isolate practitioners from germs and fluids from patients.

Typically a protective garment is disposable, but some are not. In use, the user places his or her arms through the sleeves and then the gown is secured around the neck with a tie, VELCRO® or sticky tape as well as around the wearer's waist with a tie.

Tying the collar portion of the protective garment can be cumbersome and time-consuming. Sometimes, the securing of the ties around the neck is not completely successful or not done at all. As a result, the gown can come open causing the shoulders to droop off of the wearer at inopportune times, thereby exposing both the patient and health care worker each to the other.

A recent development in attempting to solve this problem has involved the use of a bib-like device that goes over the head of the wearer. This device suffers because it musses hair and the sticky tabs can get caught in the hair.

There exists, therefore, a need for an improved method of securing the collar around the neck of a health care worker other than the methods found in the prior art.

SUMMARY OF THE INVENTION

The preferred embodiment of the present invention teaches a collar stiffener for placement inside or outside of the hem of the collar of a gown comprising a member with a thickness such that it will fit inside the hem of the collar of the gown. The member terminates in a first end and a second end wherein the member is composed of a material that is pliable enough to move with the application of force.

The above embodiment can be further modified by defining that the member is composed of a material that in addition to being pliable enough to move with the application of force, it contains sufficient memory so as to return to its original shape once the forced is released.

The above embodiment can be further modified by defining that the first end and the second end are thicker than the rod.

The above embodiment can be further modified by defining that the first end and second end are thinner than the rod.

The above embodiment can be further modified by defining that the member is made of nylon.

The above embodiment can be further modified by defining that the member is made of plastic.

The above embodiment can be further modified by defining that the first end and the second end protrude from the hem slightly.

The above embodiment can be further modified by defining that the member is made of metal.

The second embodiment of the instant invention teaches a method of quickly securing a gown around a wearer's neck comprising the steps of: sewing a member into or outside of the hem of the neck of the gown, the member having a thickness such that it will fit inside or outside of the hem of the collar of the gown. The member terminates in a first end and a second end wherein the member is composed of a material that is pliable enough to move with the application of force; gripping the neck of the gown and expanding it to a position wide enough to wrap around the wearer's neck; wrapping the gown around the wearer's neck; and releasing the member.

The above embodiment can be further modified by defining that the member is made of a material that in addition to being pliable enough to move with the application of force, it contains sufficient memory so as to return to its original shape once the forced is released.

The above embodiment can be further modified by defining that the first end and the second end are thicker than the member.

The above embodiment can be further modified by defining that the first end and the second end are thinner than the member.

The above embodiment can be further modified by defining that the member is made of nylon.

The above embodiment can be further modified by defining that the member is made of plastic.

The above embodiment can be further modified by defining that the first end and the second end protrude from said hem slightly.

The above embodiment can be further modified by defining that the member is made of metal.

BRIEF DESCRIPTION OF THE DRAWINGS

This invention can better be understood by reference to the drawings, provided for exemplary purposes, and in which.

DETAILED DESCRIPTION OF THE A PREFERRED EMBODIMENT

The instant invention seeks to solve the problem of the imperfect securing of protective garments around the collars of the wearers by placement of a stiff member through the neck hem of a typical garment. A channel is often found pre-existing in protective garments, making it very simple to add a pre-fabricated stiffening member through the channel.

The member is fed or sewn into the hem of the neck of the protective garment. The member may or may not stick out of either side ½" to 1" where the ties are typically found in the back of the open portion of the garment. The user simply spreads the two ends of the stiff member to a distance that allows it to reach around the wearer's neck and releases it to fit around the user's neck without the need to tie, VELCRO® or sticky tab the back of the garment together, thereby keeping the collar closed and the garment's shoulders in proper position during use. Once the user is done with the garment, it is simply pulled off of the neck and arms and discarded. There is no need to untie or separate any VELCRO® or sticky tabs by reaching up and around the neck to do so.

Furthermore, when installing this stiff member into the channel in the neck, the manufacturer could optionally leave the ties remaining, or any other secondary means of securement, such as VELCRO® or sticky tabs. When a health care worker must wear the garment for an extended period of time, then it may be desirable to include a secondary means of securement. However, typically health care workers are quickly in and out of areas that require the gowns. A hospital or other health care setting can use up to thirty gowns per shift.

Figure 4:
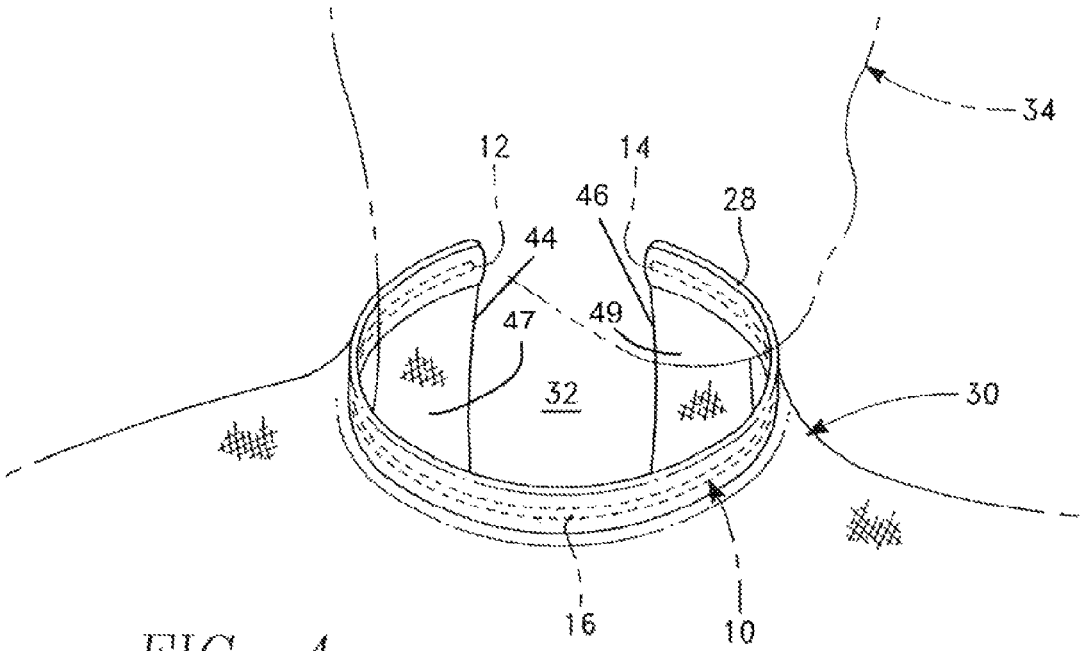
FIG. 4 is a front view of the preferred embodiment of the instant invention as it sits in the hem of the collar of a gown and wraps around the neck of a wearer.
Figure 7:
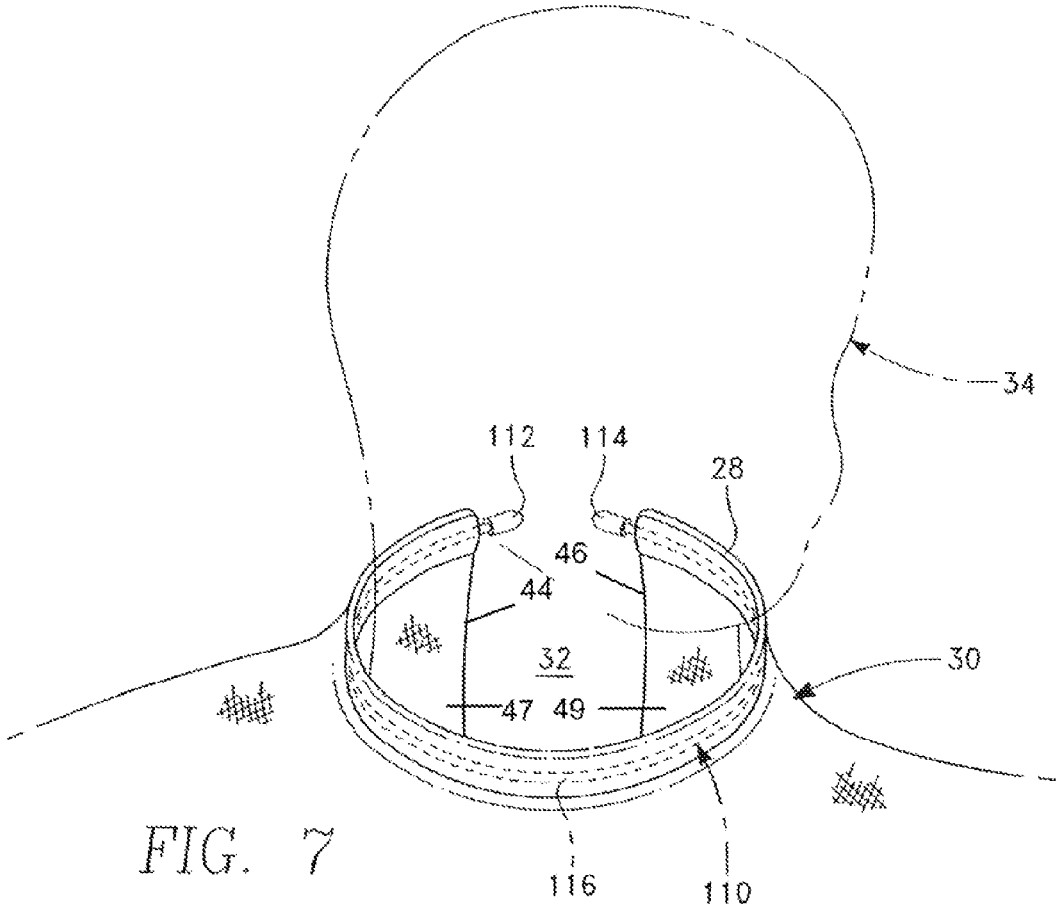
FIG. 7 is a front view of an alternate embodiment of the instant invention as it sits in the hem of the collar of a gown and wraps around the neck of a wearer.

Typical protective garments worn by health care workers are medical gowns having a closed front portion, and a back portion as shown in FIGS. 4 and 7. The back portion is capable of substantially covering the entire back torso of the wearer. The back portion comprises two flaps 44, 46. The flaps 44, 46 each comprises an edge 47, 49 extending from the hem 28 of the collar to the bottom of the back portion.

The stiff member can be made of nylon, plastic or metal wire, as long as the material used is pliable. Optionally, the material can also have a memory that will allow it to return to the closed position once force is removed by the user.

Figure 1:
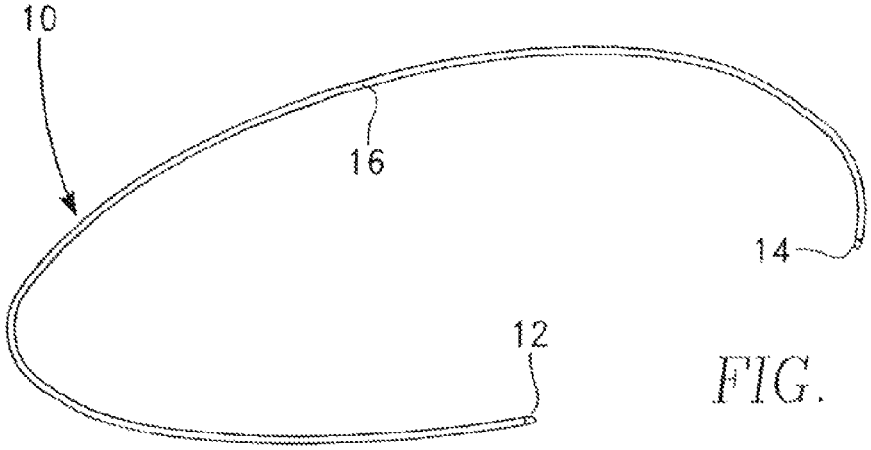
FIG. 1 is a perspective view of the preferred embodiment of the collar stiffener of the instant invention.
Figure 2:
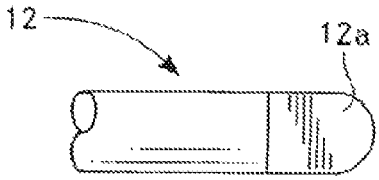
FIG. 2 is a top view of one of the ends of the preferred embodiment instant invention.
Figure 3:
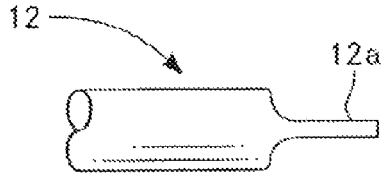
FIG. 3 is a side view of one of the ends of the preferred embodiment of the instant invention.

Illustrated in FIG. 1 is the preferred embodiment of the instant invention. The collar stiffening member 10 has a generally semi-circular shaped main portion 16 terminating in a first end 12 and a second end 14. The first end 12 and second end 14 serve to secure the member 10 inside the collar of a gown so that it does not move within the collar. In the preferred embodiment, the first end 12 and the second end 14 have a thickness that is smaller than the thickness of the main portion 16. A top view of the first end (which is the same as the second end) is seen in FIG. 2. The smaller thickness portion is shown as 12*a*. FIG. 3 shows the end in side view. The thin portion 12*a* should be of sufficient thickness to allow the placement therethrough of a sewing needle, allowing for the ends 12 and 14 to be sewn directly through the hem of the collar.

Figure 6:
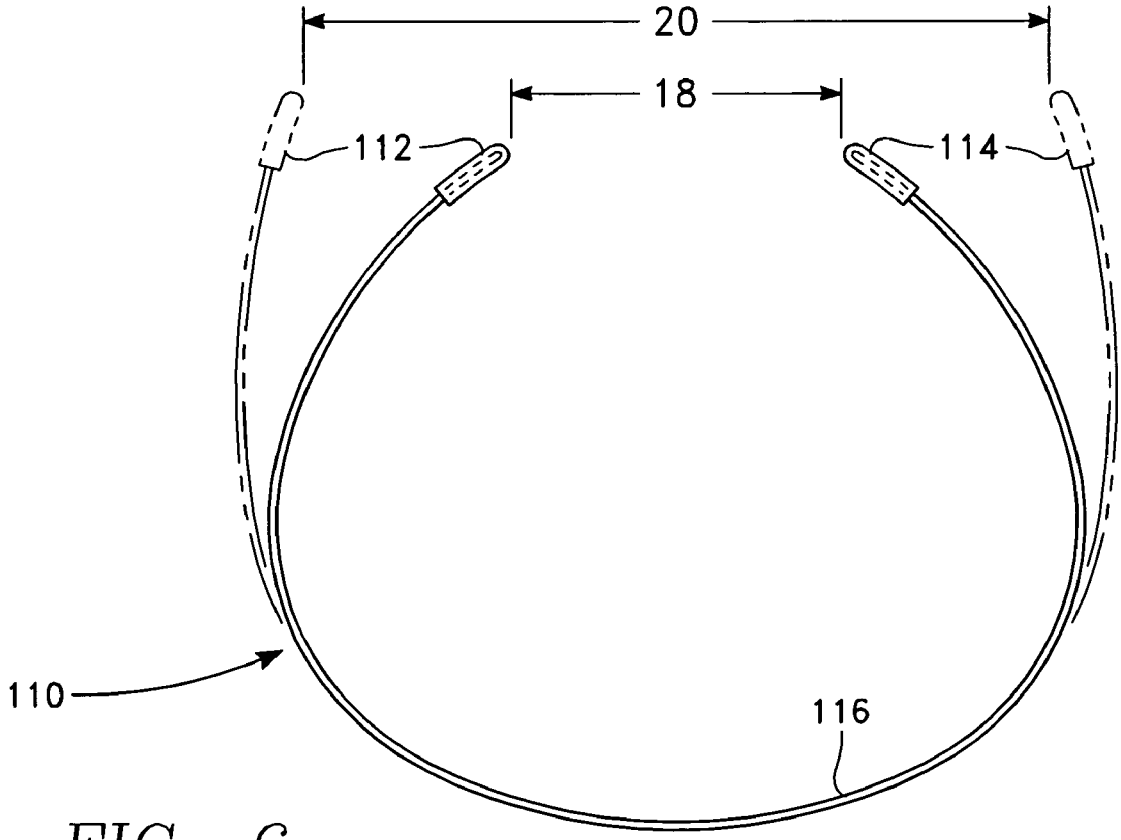
FIG. 6 is a top view of the collar demonstrating the memory of it as it expands and contracts to fit around a user's neck.

FIG. 4 shows the collar as it appears when in use. The user grips the member 10 at any point to spread the distance between the ends from the first position 18 to a second position 20 that is wide enough to allow the member 10 to easily grip around a user's neck (see FIG. 6).

FIG. 4 shows the stiffening member 10 housed inside the hem 28 of the collar of a gown 30 as it fits around the neck 32 of a user 34. The first end 12 and second end 14 can protrude from the hem 28 slightly to allow for easy grip (see the alternate embodiments FIGS. 5-10). In the preferred embodiment, however, the first end 12 and second end 14 do not protrude from the hem 28 and are designed to allow the ends 12, 14 to be sewn directly into the hem 28.

Figure 5:
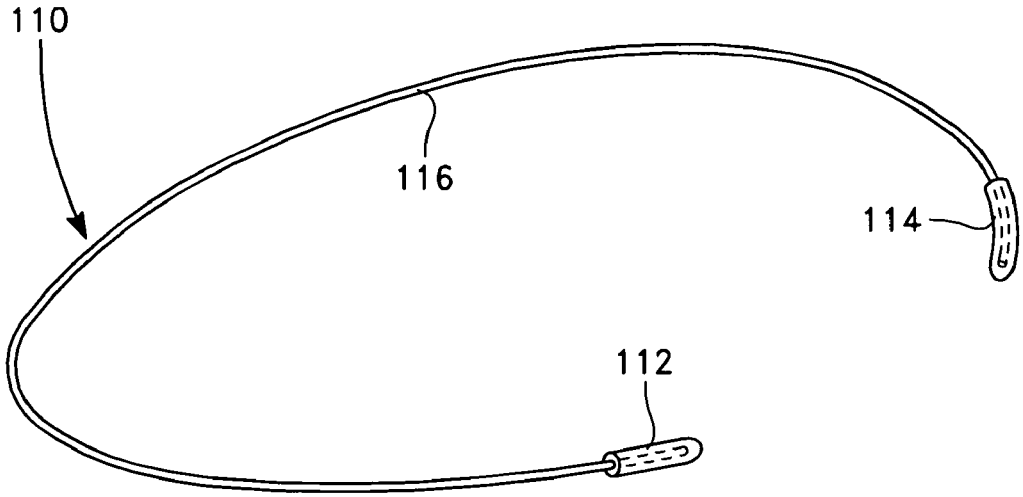
FIG. 5 is a perspective view of an alternate embodiment of the collar stiffener of the instant invention.

The first alternate embodiment of the member wherein the ends are thicker than the main body portion is illustrated in FIGS. 5 and 7. In these drawings, the member is referred to as 110, the main body is 116, the first end is 112 and the second end is 114.

Figure 8:
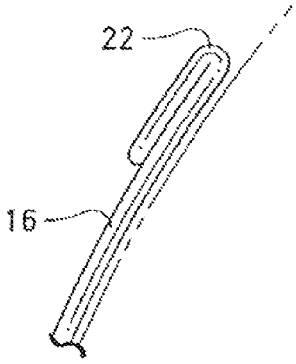
FIG. 8 is a close up view of a second alternate embodiment of the tip of the collar enclosure of the instant invention.
Figure 9:
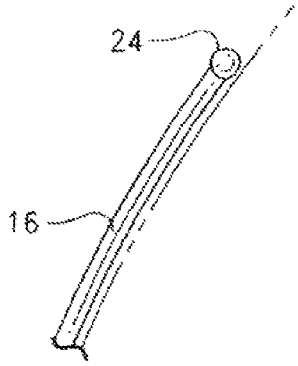
FIG. 9 is a close up view of a third alternate embodiment of the tip of the collar enclosure of the instant invention.
Figure 10:
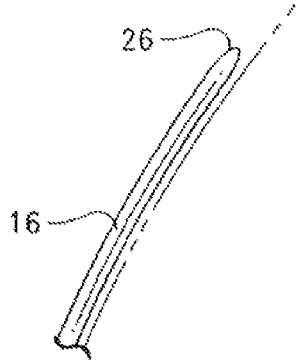
FIG. 10 is a close up view of a second alternate embodiment of the tip of the collar enclosure of the instant invention.

Alternate embodiments of the tips 12, 14 are shown in FIGS. 8-10. The tip 22 can fold over itself to create a thicker cross section as seen in FIG. 8. The tip 24 can be a ball to create a thicker cross section as seen in FIG. 9. The tip 26 can also have the same general shape as the main portion 16, but be fabricated thicker as seen in FIG. 10.

The illustrations and examples provided herein are for explanatory purposes only and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A medical garment, comprising:

a closed front portion;

a back portion substantially covering a back of the user, said back portion comprising a first flap having a first edge and a second flap having a second edge, wherein the first and second edges are adjacent when in use; and a collar stiffener for placement inside of a hem of a collar of said medical garment, said collar stiffener comprising a cylindrical, rod-shaped member having a main circular cross-section such that it will fit inside of said hem of said collar of said medical garment, said member terminating in a first end and a second end wherein said member is composed of a material that is pliable enough to move with the application of force, wherein said front portion is configured to cover a torso of a user, wherein said back portion is configured to cover a substantial portion of a back of said user while allowing said medical garment to be donned through said back portion, and wherein said collar stiffener is configured to wrap around a neck of said user, wherein said first end and said second end each terminate into a substantially thin, flattened portion, wherein each portion is secured to the collar inside the hem.

2. The medical garment as defined in claim 1 wherein said member is composed of a material that is both pliable enough to move with the application of force and that contains sufficient memory so as to return to its original shape once said force is released.

3. The medical garment as defined in claim 1 wherein said member is made of nylon.

4. The medical garment as defined in claim 1 wherein said member is made of plastic.

5. The medical garment as defined in claim 1, wherein said medical garment further comprises a tie on said collar as a secondary securement.

6. The medical garment of claim 1, wherein said collar stiffener is irremovable from said hem.

7. The medical garment as defined in claim 1, wherein said member is made of metal.

8. A method of quickly securing a medical garment around a wearer's neck for use in a medical environment, comprising the steps of:

providing a medical gown having a closed front portion and a back portion comprising two flaps having adjacent edges when in use;

providing a member secured around a hem of a collar of said medical gown, said member having a substantially semi-circular configuration with a circular cross-section, and having a thickness such that said member fits inside of said hem of said collar of said medical gown, said member terminating in a first end and a second end wherein said member is composed of a material that is pliable enough to move with the application of force;

gripping said member and expanding it to a position wide enough to wrap around said wearer's neck;

wrapping said protective garment around said wearer's neck; and releasing said member to secure said medical garment around said wearer's neck for use in said medical environment, wherein said first end and said second end each comprises a generally thin, flattened portion, wherein each of said thin flattened portion comprises stitching to secure said member to said hem.

9. The method as defined in claim 8 wherein said member is composed of a material that is both pliable enough to move with the application of force and that contains sufficient memory so as to return to its original shape once said force is released.

10. The method as defined in claim 8 wherein said member is made of nylon.

11. The method as defined in claim 8 wherein said member is made of plastic.

12. The method as defined in claim 8 wherein said member is made of metal.

* * * * *